US006720041B2

(12) United States Patent
Yoshino et al.

(10) Patent No.: US 6,720,041 B2
(45) **Date of Patent: *Apr. 13, 2004**

(54) RECORDING MEDIUM, AND METHOD FOR PRODUCING IMAGE USING THE SAME

(75) Inventors: Hitoshi Yoshino, Zama (JP); Kyo Miura, Yokohama (JP); Yuji Kondo, Machida (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 31 days.

(21) Appl. No.: 09/441,877

(22) Filed: Nov. 17, 1999

(65) Prior Publication Data

US 2003/0064200 A1 Apr. 3, 2003

(30) Foreign Application Priority Data

Nov. 20, 1998 (JP) ..... 10-331577

(51) Int. Cl.[7] ..... B41M 5/00

(52) U.S. Cl. ..... 428/32.24; 428/32.31; 428/32.18; 428/32.21; 428/32.34

(58) Field of Search ..... 428/195, 331, 428/212, 32.24, 32.31, 32.18, 32.21, 32.34

(56) References Cited

U.S. PATENT DOCUMENTS

| | | | | |
|---|---|---|---|---|
| 4,242,271 A | | 12/1980 | Weber et al. | 260/448 AD |
| 4,734,336 A | | 3/1988 | Oliver et al. | 428/537.5 |
| 4,879,166 A | | 11/1989 | Misuda et al. | 428/212 |
| 5,104,730 A | | 4/1992 | Misuda et al. | 428/304.4 |
| 5,635,291 A | | 6/1997 | Yoshino et al. | 428/304.4 |
| 5,679,451 A | | 10/1997 | Kondo et al. | 428/304.4 |
| 5,707,716 A | | 1/1998 | Yoshino et al. | 428/212 |
| 5,846,647 A | | 12/1998 | Yoshino et al. | 428/328 |
| 5,849,447 A | * | 12/1998 | Matsuda | 430/97 |
| 5,882,755 A | * | 3/1999 | Igarashi et al. | 428/41.8 |
| 5,888,367 A | * | 3/1999 | Mouri et al. | 204/483 |
| RE36,303 E | * | 9/1999 | Ogawa et al. | 428/341 |
| 5,955,142 A | | 9/1999 | Yoshino et al. | 427/205 |
| 5,955,185 A | | 9/1999 | Yoshino et al. | 428/304.4 |
| 5,965,252 A | | 10/1999 | Santo et al. | 428/329 |
| 6,000,794 A | | 12/1999 | Kondo et al. | 347/105 |

FOREIGN PATENT DOCUMENTS

| | | | | |
|---|---|---|---|---|
| EP | 0709222 | * | 5/1996 | B41M/5/00 |
| EP | 0 750 067 A2 | | 12/1996 | |
| EP | 0 967 088 A2 | | 12/1999 | |
| JP | 51-38298 | | 3/1976 | |
| JP | 53-49113 | | 5/1978 | |
| JP | 54-59936 | | 5/1979 | |
| JP | 55-5830 | | 1/1980 | |
| JP | 55-51583 | | 4/1980 | |
| JP | 56-57177 | | 5/1981 | |
| JP | 56-120508 | | 9/1981 | |
| JP | 58-8685 | | 1/1983 | |
| JP | 60-27588 | | 6/1985 | |
| JP | 61-50795 | | 11/1986 | |
| JP | 63-118287 | | 5/1988 | |
| JP | 1-78877 | | 3/1989 | |
| JP | 2-243381 | | 9/1990 | |
| JP | 2-243382 | | 9/1990 | |
| JP | 2-251967 | | 10/1990 | |
| JP | 2-276670 | | 11/1990 | |
| JP | 3-180599 | | 8/1991 | |
| JP | 4-202011 | | 7/1992 | |
| JP | 4-267180 | | 9/1992 | |
| JP | 5-16517 | | 1/1993 | |
| JP | 5-32413 | | 2/1993 | |
| JP | 5-32414 | | 2/1993 | |
| JP | 5-16015 B2 | | 3/1993 | |
| JP | 5-98593 | | 4/1993 | |
| JP | 5-106197 | | 4/1993 | |
| JP | 6-143793 | | 5/1994 | |
| JP | 6-158575 | | 6/1994 | |
| JP | 6-158579 | | 6/1994 | |
| JP | 6-219043 | | 8/1994 | |
| JP | 6-248594 | | 9/1994 | |
| JP | 6-287886 | | 10/1994 | |
| JP | 6-312572 | | 11/1994 | |
| JP | 7-3691 | | 1/1995 | |
| JP | 7-25131 | | 1/1995 | |
| JP | 7-25132 | | 1/1995 | |
| JP | 7-54300 | | 2/1995 | |
| JP | 2714350 B2 | | 9/1995 | |
| JP | 2714351 B1 | | 9/1995 | |
| JP | 2714352 B2 | | 9/1995 | |
| JP | 7-232473 | | 9/1995 | |
| JP | 7-232474 | | 9/1995 | |
| JP | 7-232475 | | 9/1995 | |
| JP | 8-667 | | 1/1996 | |
| JP | 8-3892 | | 1/1996 | |
| JP | 8-132731 | | 5/1996 | |
| JP | 8-174993 | | 7/1996 | |
| JP | 08-232189 | * | 9/1996 | D21H/11/20 |

(List continued on next page.)

OTHER PUBLICATIONS

Bucher, D., "Identifying Rolls with Laser Scanning of Barcodes," Tappi Journal, vol. 69, No. 7, pp. 40–41, Jul. 1986.

Dion, et al., "Preliminary Test Results of a New Acousto–optical Process for On–line Characterization of Fiber Size," Tappi Journal, pp. 161–162, Apr. 1987.

(List continued on next page.)

*Primary Examiner*—Cynthia H. Kelly
*Assistant Examiner*—B. Shewareged
(74) *Attorney, Agent, or Firm*—Fitzpatrick, Cella, Harper & Scinto

(57) ABSTRACT

Provided is a recording medium of a multi-layered structure comprising a base layer and a surface layer provided on at least one side of the base layer, wherein the base layer is mainly composed of fibrous material and the surface layer comprises an alumina hydrate of a boehmite structure incorporated in the fibrous material.

19 Claims, No Drawings

FOREIGN PATENT DOCUMENTS

| | | |
|---|---|---|
| JP | 8-258400 | 10/1996 |
| JP | 8-267907 | 10/1996 |
| JP | 8-284090 | 10/1996 |
| JP | 8-291494 | 11/1996 |
| JP | 9-66664 | 3/1997 |
| JP | 9-76628 | 3/1997 |
| JP | 9-99627 | 4/1997 |
| JP | 9-170190 | 6/1997 |
| JP | 9-239903 | 9/1997 |
| JP | 10-131091 | 5/1998 |
| JP | 10-204790 | 8/1998 |
| JP | 10-212690 | 8/1998 |
| JP | 10-259587 | 9/1998 |
| JP | 11-200282 | 7/1999 |
| JP | 2000-79755 | 3/2000 |
| SU | 971979 | * 11/1982 |

OTHER PUBLICATIONS

Votava, R.J., "A Practical Method—Measuring Paper Asymmetry Regarding Fiber Orientation," Tappi Journal, vol. 65, No. 4, pp. 67–70, Apr. 1982.

Josef Roček, et al., "Porous Structure of Aluminium Hydroxide and its Content of Pseudoboehmite", Applied Catalysis, vol. 74, (1991) pp. 29–36.

* cited by examiner

RECORDING MEDIUM, AND METHOD FOR PRODUCING IMAGE USING THE SAME

BACKGROUND OF THE INVENTION

1. Field of the Invention

This invention relates to a recording medium suitable for recording with the aid of ink, more particularly an ink-jet recording medium, which is high in optical density of image, bright in color tone and high in ink absorptivity, while a surface thereof keeps a touch feeling of plain paper, a method for producing an image using the recording medium, and printed matter produced by the method.

Advanced ink-jet recording methods, which eject minute droplets of ink by various working principles onto recording media, such as paper or the like, to record images, letters or the like thereon, are characterized by, e.g., high speed, low noise, easiness in multi-coloration, large flexibility of recorded patterns, and needing no development or fixation step. They are rapidly coming into wide use for various purposes, e.g., information devices and other recording devices to produce various types of images. The images produced by the multi-color ink-jet method compare favorably with those produced by the color plate making or color photographic system. They are less expensive than those produced by the ordinary color printing or photography, when the number of copies is fairly small, and are going even into the area of full-color image recording.

2. Related Background Art

Ink-jet recording devices and methods have been advanced to improve recording characteristics, e.g., increased speed of recording, increased precision and full coloration. The recording media have been also required to have improved characteristics. Variety types of recording media have been proposed to solve the problems involved in the conventional media. For example, Japanese Patent Application Laid-Open No. 55-5830 proposes an ink-jet recording paper provided with an ink-absorptive coating layer on the base. Japanese Patent Application Laid-Open No. 55-51583 proposes the coating layer containing amorphous silica as a pigment. U.S. Pat. Nos. 4,879,166 and 5,104,730, and Japanese Patent Application Laid-Open Nos. 2-276670, 5-32413 and 5-32414 propose a recording sheet coated with an ink-receiving layer comprising alumina hydrate of pseudo-boehmite structure. These media have an ink-receiving layer containing a pigment, e.g., alumina or silica, on the base. They carry no touch feeling of plain paper, even when a paper is used as a base, because of the ink-receiving layer covering the base. In order to obtain a recording medium like a plain paper, for example, Japanese Patent Application Laid-Open Nos. 6-312572, 7-25131 and 7-25132 propose a recording medium comprising a paper base coated with trace quantities of ultrafine particles, the recording surface of which keeps a fibrous form of pulp and is covered with ultrafine particles of pigment at least 70%.

On the other hand, a medium with a filler incorporated in paper is proposed. For example, Japanese Patent Application Laid-Open No. 53-49113 proposes a recording medium comprising a sheet incorporated with urea-formalin resin particles, on which a water-soluble polymer is applied and impregnated. Japanese Patent Application Laid-Open No. 58-8685 proposes a recording medium comprising a sheet incorporated with synthetic silicate or glass fibers, on which a water-soluble polymer is applied and impregnated. These media have improved ink absorptivity by incorporating specific fine particles in a non-sized paper sheet. There are proposed media comprising a sheet incorporated with a fine sizing agent. For example, Japanese Patent Publication No. 60-27588 proposes a recording medium comprising a sheet having a Stöckigt sizing degree of 3 seconds or less, incorporated with a wet strength-enhancing agent and coated with a surface coating material. Japanese Patent Publication No. 61-50795 (corresponding to Japanese Patent Application Laid-Open No. 56-57177) proposes a recording paper coated with a saponified-type sizing agent. In these media dot diameters are controlled by suppressing an ink absorptivity by subjecting them to a sizing treatment. Japanese Patent Nos. 2,714,350, 2,714,351 and 2,714,352 (corresponding to Japanese Patent Application Laid-Open Nos. 7-232473, 7-232474 and 7-232475, respectively) propose a recording paper incorporated with an amorphous alumina hydrate.

A paper medium of multi-layered structure is another type of paper incorporated with an additive. For example, Japanese Patent Application Laid-Open No. 63-118287 and U.S. Pat. No. 4,734,336 propose a non-coated paper comprising a support layer of pulp fibers and surface layer composed of a filler such as silica and fibers, placed one on another. Japanese Patent Application Laid-Open Nos. 1-78877, 2-243381, 2-243382 and 5-106197 propose a multi-layered paper prepared by a multi-layer paper-making process, in which the base layer or interface between the base and surface layers is subject to a sizing treatment. Japanese Patent Application Laid-Open No. 6-219043 proposes a multi-layered paper having a surface layer impregnated with an inorganic compound sparingly soluble or insoluble in water. Japanese Patent Application Laid-Open Nos. 6-287886, 7-54300 and 8-258400 propose a multi-layered paper produced from specific pulp, such as bulky cellulose, mercerized pulp, bleached broadleaf sulfite pulp and the like. Japanese Patent Application Laid-Open No. 9-170190 proposes a multi-layered paper comprising a surface layer and base layer, the former composed of hydrophilic and hydrophobic fibers as the major ingredients, and the latter mainly composed of cellulosic fibers.

However, the conventional recording media involve the following problems:

(1) In the recording medium comprising a base coated with the ink-receiving layer, no touch feeling of paper remains, even when paper is used as the base, because it is coated thickly with a pigment or the like. Decreasing coating thickness can bring about touch feeling of paper, but an absorption of an ink or a coloristic performance may be impaired.

(2) The recording medium comprising the non-sized paper incorporated with a specific fine powder shows a good ink absorptivity, but may cause strike-through of an ink, when it is used for multi-color printing. This will result in broadened printing dots or insufficient optical density. On the other hand, the recording medium comprising a sheet incorporated with a fine sizing agent, although free of the strike-through problems, involves problems of insufficient ink absorptivity, flooding or bleeding of the ink when the medium is used for multi-color printing, and an insufficient optical density of prints.

(3) The multi-layered recording medium can be free of problems of ink strike-through or show-through from the back side, when the base layer is incorporated with a sizing agent or the interface between the surface and base layers is subjected to a sizing-treatment. This, however, limits penetration of ink into the base layer, which may cause flooding of the ink when the medium is used for multi-color or high-speed printing. The pigments to be incorporated include calcium carbonate, clay, kaoline, acidic clay, talc, synthetic silica and titanium dioxide, which, however, are difficult to satisfy required ink absorption, coloration or resolution. The multi-layered paper produced from specific pulp, such as bulky cellulose, mercerized pulp and bleached broadleaf sulfite pulp, is highly water absorptive and diffusive, but poorly fixes coloring agents, when used in an ink-jet system, tending to widen printed dot diameter or allow the ink to bleed, causing insufficient optical density. Japanese Patent Application Laid-Open No. 8-258400 proposes a multi-layered recording medium with each layer having different sizing degree to improve ink absorptivity and also incorporated with a filler, e.g., silica, calcium carbonate or titanium dioxide. However, incorporation of the filler tends to deteriorate a resolution and an optical density. The recording medium having hydrophilic and hydrophobic fibers has good electrophotographic characteristics and is suitable for an ink-jet system, but the presence of hydrophobic fibers such as polyester may cause bleeding or repelling when it is used for high-speed multi-color printing.

SUMMARY OF THE INVENTION

It is an object of the present invention to solve the above problems, i.e., to provide a recording medium, which is high in ink absorptivity and optical density of the print, and little suffering powder drop-off or curling, while a surface thereof keeps a touch feeling of plain paper, and method for producing images using the recording medium and printed matter produced by the method.

The above object can be achieved by the present invention described below.

According to the present invention, there is provided a recording medium of a multi-layered structure comprising a base layer and a surface layer provided on at least one side of the base layer, wherein the base layer is mainly composed of fibrous material and the surface layer comprises an alumina hydrate of a boehmite structure incorporated in the fibrous material.

According to the present invention, there is also provided a recording medium of a 3-layered structure having a base layer, a surface layer and a back layer, wherein the base layer is mainly composed of fibrous material, the surface layer comprises an alumina hydrate of boehmite structure incorporated in the fibrous material and a back layer is provided on an opposite side of the surface layer of the base layer.

According to the present invention, there is further provided a method for producing images by ejecting ink-droplets from orifices and depositing the ink-droplets on a recording medium to conduct printing, wherein the recording medium is a recording medium described above.

The recording medium of the present invention is good in ink solvent absorptivity, high in optical density of the print, little at powder drop-off or curling, and is excellent in fastness to water, while a surface thereof keeps a touch feeling of plain paper.

DETAILED DESCRIPTION OF THE PREFERRED EMBODIMENTS

The inventors of the present invention have proposed recording media containing an amorphous alumina hydrate incorporated in the fibrous material (see Japanese Patent Nos. 2,714,350 to 2,714,352 and Japanese Patent Application Laid-Open No. 9-99627). The recording medium of the present invention is an improvement on the previous ones. It is a multi-layered recording medium comprising a surface layer and a base layer, wherein an alumina hydrate of boehmite structure is incorporated only in the surface layer. The inventors of the present invention have found that an excellence in a coloring performance and a resolution of printed images can be compatible with the matters of rapid ink-absorption rate and of causing no ink-flooding, when a recording medium incorporated with an alumina hydrate of boehmite structure is made to a multi-layered structure having a surface layer and a base layer, in which the alumina hydrate is incorporated only in a surface layer and a material of high liquid absorptivity is used for a base layer, even when high speed printing is conducted. The recording medium of the present invention shows particularly notable effects, when the images are printed thereon by a superhigh-speed printer which uses a full-line head or the like. There can be brought by the present invention various advantages that a coloristic performance and a resolution of printed images can be noticeably improved, even when printed at a high speed, that inks can be quickly absorbed and that no strike-through occurs.

Incorporation of an alumina hydrate in the surface layer can exhibit a technical merit to reduce a required quantity of the hydrate to the whole, while keeping a good coloristic performance. In addition, use of an alumina hydrate of boehmite structure brings another advantage of increasing productivity, because of high yield of alumina hydrate to cellulosic fibers.

An alumina hydrate is a preferable material for an ink-jet recording medium, because it is positively charged, so that the recording medium of the present invention is good in fixing coloring agents, such as dyes, in the ink, and can provide excellently colored images. Moreover, it is free of problems, such as brown-turning or bronzing of black portions and insufficient fastness to light.

As an alumina hydrate of a boehmite structure present in the recording medium of the present invention, the one showing the boehmite structure analyzed by an X-ray diffractometry is most preferable, because of its good ink absorptivity, fixing ability of a coloring material and coloristic performance.

An alumina hydrate is represented by the following chemical formula:

$$Al_2O_{3-n}(OH)_{2n}\cdot mH_2O$$

wherein, n is an integer of from 0 to 3, and m is from 0 to 10, preferably from 0 to 5. The expression $mH_2O$ generally represents the water phase which is not involved in formation of the crystal lattice and hence can be removed. Therefore, m may not be an integer. However, m and n are not simultaneously zero. A crystalline alumina hydrate of boehmite structure, in general, is a layered compound having the (020) plane of wide area. It shows characteristic X-ray diffraction peaks. The boehmite structure may be a perfect one or pseudo-boehmite, which contains an excessive quantity of water between the layers of the (020) plane. Pseudo-boehmite shows broader X-ray diffraction peaks than the perfect one. Perfect and pseudo-boehmite structures cannot be clearly distinguished from each other, and alumina hydrate of boehmite structure described in this specification includes both types, unless otherwise stated.

The alumina hydrate of boehmite structure for the present invention is preferably the one which shows a boehmite structure when analyzed by an X-ray diffractometry, because of its high color density, resolution and ink absorptivity. The alumina hydrate may contain a metallic oxide, such as titanium dioxide or silica, so long as it takes a boehmite structure.

The method for producing the alumina hydrate used in the present invention is not limited. It may be produced by a known method, when it produces a boehmite structure, for example, hydrolysis of aluminum alkoxide or sodium aluminate. An alumina hydrate, which is X-ray diffractometrically amorphous, can be converted into a boehmite structure when heated at 50° C. or more in the presence of water, as disclosed by Japanese Patent Application Laid-Open No. 56-120508.

The recording medium of the present invention comprises a surface layer and a base layer, where each layer is mainly composed of cellulosic fibers, and an alumina hydrate is incorporated only in the surface layer. The coloring agents in the ink printed on the recording medium of the present invention are absorbed by the surface layer, and the solvent component in the ink is absorbed by the base layer, after passing through the surface layer. The surface of the recording medium of the present invention preferably has a touch feeling of plain paper, by which is meant that the cellulosic fibers are exposed and the surface gives no feeling of coating with fine particles, when touched.

The recording medium of the present invention may be so constituted that surface layers are provided on both side of the base layer and printing can be conducted on both surface thereof, or that a back layer is provided on one side opposite to the surface layer of the base layer, as needed. The back layer, like the base layer, is composed mainly of cellulosic fibers and contains no alumina hydrate.

Content of an alumina hydrate of boehmite structure is preferably 50% by weight or less on total weight of the surface layer. Within this range, a good coloristic performance can be shown without deteriorating touch feeling of paper of the surface layer. The more preferable content is 2 to 30% by weight, as the recording medium surface shows little powder drop-off or fluffing, when rubbed. The most preferable content is 5 to 20% by weight, as the printed medium is more resistant to tearing or wrinkling under wet conditions which decrease paper strength. The content thereof on the whole recording medium is preferably 1 to 20% by weight, as the printed image thereon will have a high color density and a good color tone at the mixed color portion.

An alumina hydrate is incorporated with cellulosic fibers in the surface layer of the recording medium of the present invention by a method of blending an aqueous dispersion of the hydrate with a cellulosic pulp dispersion and making paper from the dispersion, or by coating the paper with the aqueous dispersion.

The cellulosic pulp used in the surface, base and back layers of the recording member of the present invention is not limited. There can be used chemical pulp, such as sulfite pulp (SP) from broadleaf or coniferous trees, alkali pulp (AP), kraft pulp (KP) and the like; semi-chemical pulp; semi-mechanical pulp and the like; mechanical pulp; and used paper pulp as deinking secondary fibers. The pulp may be bleached or not, or beaten or not. As cellulosic pulp there may be used non-wooden pulp from weeds, leaves, bast or fibers (such as those of seeds), more concretely, from straws, bamboo, hemp, bagasse, kenaf, mitsumata, cotton linter. The fibers for these layers may be also recycled one, such as rayon, so long as they are hydrophilic, or hydrophilic synthetic polymer fibers, such as those of cellulose derivatives, polyvinyl alcohol and polyacrylamide. They may be incorporated with a filler, as required.

Basis weight of the whole recording medium is not limited, unless the recording medium is extremely thin, but preferably in a range of from 40 to 300 g/m$^2$ from the point of conveyability in printing by a printer. It is more preferably in a range of from 60 to 200 g/m$^2$, as opaqueness of the paper can be increased without increasing its bending strength of paper. Another advantage is prevention of papers from sticking to each other, when a number of printed papers are placed one on another.

Basis weight of the surface layer for the recording medium of the present invention is preferably 5 g/cm$^2$ or more and occupies 40% by weight or less of the whole recording medium. Within this range, printed color materials can be absorbed by the surface layer, even when the images are printed at a high speed, and the printed portion has a high optical density to prevent beading or bleeding. It is more preferably to be 10 g/cm$^2$ or more and to occupy 30% by weight or less of the whole recording medium, by which curling of the medium at a humidity in the preservation or printing atmosphere can be efficiently prevented, and also curling or waving after printing can be prevented.

Bleeding is a phenomenon in which a colored portion with a coloring material such as dye becomes wider or larger than a printed area, when solid printing is conducted over a certain area. Beading is a phenomenon to cause granular unevenness in density due to agglomerating ink droplets with each other at a solid printed portion. Repelling is a phenomenon in which a part of solid printed portions is not colored.

A preferred surface layer of the recording medium of the present invention can be produced by one of the following three methods, as needed.

The first method is of using fine cellulose fibrils, such as those disclosed by Japanese Patent Application Laid-Open Nos. 7-3691 and 8-284090, in addition to the above-mentioned cellulosic pulp. The fine cellulose fibrils are obtained by finely dividing cellulosic fibers from wood pulp to a fibril as the constituent unit that forms cellar membranes, massively branched while keeping a fibrous shape. It is preferable to incorporate the fibrils into the cellulosic fibers at 1 to 50% by weight of the total cellulose for the surface layer, to improve color tone of the printed image, in particular brightness of the mixed color portion. The more preferable content is 1 to 30% by weight of the total cellulose for the surface layer, as depth of color tone of the printed image is enhanced, and the medium will suffer little fluffing or powder drop-off of alumina hydrate incorporated, when the surface layer is rubbed. The most preferable content is 3 to 20% by weight, as smoothness of the recording medium surface is enhanced, and the surface is free of tack even immediately after printing.

The second method is of using, in addition to the above-mentioned cellulosic pulp, sulfate pulp, sulfite pulp, soda pulp and the like from broadleaf or coniferous trees, as disclosed by Japanese Patent Application Laid-Open No. 7-54300, and more preferably sulfate pulp with thin fiber walls from broadleaf trees, as disclosed by Japanese Patent Application Laid-Open Nos. 8-258400 and 8-267907. It is preferable to incorporate the sulfate pulp or the like into the cellulosic fibers at 50% by weight or more of the total cellulose for the surface layer, to reduce wetting or curling of the printed medium. The more preferable content is 70% by weight or more, so that roundness of the printed dot can be increased.

The third method is of using, in addition to the above-mentioned cellulosic pulp, bulky or porous cellulosic fiber such as bulky cellulosic fibers disclosed by Japanese Patent Application Laid-Open No. 6-287886, mercerized cellulose disclosed by Japanese Patent Application Laid-Open No. 7-54300, and fluffed cellulose disclosed by Japanese Patent Application Laid-Open No. 8-667. It is preferable to incorporate the bulky or porous fiber within a range of from 1 to 30% by weight of the total cellulose for the surface layer, so that ink absorption rate can be increased and bleeding and beading can be prevented. The more preferable content is 1 to 10% by weight, so that fixation of the printed color materials can be accelerated.

The surface layer may be also incorporated with an enzymatically treated pulp, as required, to improve its surface smoothness. Such pulp is not limited specifically, but there is included a pulp which is subjected to a beating treatment after hemicellulase is added to unbeaten pulp, as disclosed by Japanese Patent Application Laid-Open No. 6-158575, and a chemical pulp which is beaten and then treated with an enzyme having cellulose hydrolyzing activity, as disclosed by Japanese Patent Application Laid-Open No. 10-259587.

In the present invention it is necessary that the base layer has an ink absorptivity higher than that of the surface layer. Ink absorptivity of each layer or a whole recording medium is generally determined by a method to find a Stöckigt sizing degree or to find a time required for an ink to move from a contact surface of the ink to an opposite side, as disclosed by Japanese Patent Application Laid-Open No. 6-143793. However, ink absorption rate of the recording medium of the present invention is too high to be determined by these methods. Therefore, the absorption rate of the layers or the recording medium of the present invention can be measured by a dynamic scanning absorpto meter, disclosed by Japanese Patent Application Laid-Open No. 10-131091. Absorption rate measured by this method for each layer and the whole recording medium is represented by a wetting time and an absorption coefficient, which are measured by using pure water or a water-based ink containing a surfactant. In the present invention it is assumed that the base layer has an ink absorptivity higher than the surface layer, when the absorption rate of the base layer becomes higher that of the surface layer, or the absorption rate of a combination of the base layer and the surface layer becomes higher than that of the surface layer alone.

The recording medium of the present invention preferably has a wetting time of 15 milliseconds or less with various types of liquid. In this range, an occurrence of beading can be prevented, irrespective of ink composition. It preferably has an absorption coefficient of 5 $ml/m^2s^{-1/2}$ or more with various types of liquid. In this range, occurrences of bleeding, repelling or beading can be prevented, even when multiple printing is effected at a high speed.

A method to make the ink absorptivity of the base layer higher than that of the surface layer can be selected from one or more of the following three methods.

The first method is of using different types of cellulosic pulps for the base and surface layers in that the former has a lower beating degree than the latter, where beating degree is represented by Canadian Standard Freeness (CSF). It is preferable that the difference in CSF is 10 or more, as the base layer quickly absorbs the ink's solvent component passing through the surface layer. The difference is more preferably 50 or more, as the base layer quickly absorbs the solvent component, even when multiple printing is effected. It is also preferable that the cellulosic pulp for the base layer is cross-linked, because cockling can be prevented.

The second method is of using a highly absorptive material, such as an absorptive resin, for the base layer. The absorptive material is not limited, but preferably absorbs at least 3 times larger quantity of liquid than its own weight. The absorptive materials used in the present invention include those based on starch, cellulose and synthetic polymer. More concretely, they include starch/acrylate graft copolymer, saponified product of starch-acrylonitrile copolymer, saponified product of starch-ethyl acrylate graft copolymer, saponified product of starch-methyl methacrylate graft copolymer, saponified product of starch-acrylonitrile graft copolymer, saponified product of starch-acrylamide graft copolymer, saponified starch-acrylonitrile-2-acrylamide-methyl propane sulfonic acid graft terpolymer, acrylate polymer, polyethylene oxide cross-linked with acrylic acid, cross-linked product of sodium carboxymethyl cellulose, and cross-linked product obtained by a reaction between polyvinyl alcohol and maleic anhydride. Use of fibrous cellulose, such as fibrous carboxyl cellulose disclosed by Japanese Patent Application Laid-Open No. 9-239903, is preferable, since an ink absorption rate can be improved and no deformation resulting from swelling occurs. The highly absorptive material is preferably cross-linked, since cockling can be prevented. Content of the highly absorptive material is preferably within a range of from 1 to 30% by weight on the cellulosic fibers, because of high absorptivity of the base layer and controlled sticky feeling. The more preferable content is within a range of from 1 to 10% by weight, because of improved feeling of touch and bending strength of the medium.

The third method is of using, in addition to cellulosic fibers, bulky or porous cellulosic fibers, such as bulky cellulosic fibers disclosed by Japanese Patent Application Laid-Open No. 6-287886, mercerized cellulose disclosed by Japanese Patent Application Laid-Open No. 7-54300, and fluffed cellulose disclosed by Japanese Patent Application Laid-Open No. 8-667.

A material used for common low-density paper may be also used. These materials include mechanical pulp, such as thermomechanical pulp of pine trees as disclosed in Japanese Patent Application Laid-Open No. 5-98593; coniferous pulp having a specific water retention and broadleaf pulp having a specific water retention, mixed with each other in a specific ratio as disclosed in Japanese Patent Application Laid-Open No. 6-158579; modified bacteria cellulose disclosed by Japanese Patent Application Laid-Open Nos. 6-248594, 8-3892 and 11-200282; a mixture of bacteria cellulose and broadleaf pulp having a specific water retention in a specific ratio; a mixture of bacteria cellulose and foam resins; pulp from lumber containing Southern broadleaf trees, treated with an aqueous solution of sodium hydroxide to have a CFS of 400 ml or more as disclosed in Japanese Patent Application Laid-Open No. 8-291494; LBKP having a CFS of 500 ml or more containing Dipterocarpaceae pulp as disclosed in Japanese Patent Application Laid-Open No. 10-204790; and fine fibers having a binding strengthening factor of 0.15 or more and curled fibers having a wet curl factor within a range of from 0.4 to 1.0 as disclosed in Japanese Patent Application Laid-Open No. 10-212690. One or more of these materials may be used, as required.

Content of bulky or porous cellulose is not limited, but preferably in a range of from 10 to 90% by weight. Within this range, the printed ink moves quickly from the surface layer, so that bleeding is difficult to occur, when multiple printing is effected. The more preferable content is 30 to 70% by weight, since the base layer surface can be made smooth, and cockling, wrinkling or waving of the base layer can be prevented after printing.

Because in the present invention inks are absorbed in the base layer, the base layer is preferably non-sized, or very close one thereto. It differs from the one whose ink absorptivity is controlled by sizing to prevent strike-through, as disclosed by Japanese Patent Application Laid-Open Nos. 1-78877, 2-243381, 2-243382, 3-180599 and 6-219043.

In the recording medium of the present invention a back layer can be formed, as required. The back layer is composed mainly of cellulosic fibers, and free of alumina hydrate. The cellulosic fibers used in the back layer are not limited, and may be selected from the above-mentioned ones. Basis weight of the back layer is preferably 30% by weight or less on the whole recording medium.

The multi-layer recording medium of the present invention may be produced by a method in which each of the pulp mixtures for the surface and base layers are prepared for paper-making, or by a method in which the base layer is formed, and then coated with a pulp mixture for the surface layer and dried.

The former method may be selected from the known ones generally used for multi-layered papers. Multi-layer paper-making is preferable, because a separation between the layers, such as surface and base layers, is difficult to occur. Known paper-making machines may be used. They include a Fourdrinier paper-making machine, a cylinder paper-making machine, a drum, a twin wire or the like. The method which forms layered paper by moving paper stocks for each layer in parallel to each other from stock inlets, by the aid of a single head box for producing multi-layered paper, is more preferable, because the paper stocks of the adjacent layers are adequately mixed with each other in the interface between them to increase strength in the Z direction. The single head boxes used in the present invention include, for example, Strata-Flo (trade name, available from Beloit Corporation), Contro-Flo (trade name, available from Tampella Co., Ltd.), HTB-3L (trade name, available from KMW Co., Ltd.) and the like.

The surface layer may be formed by a known method. A pulp composition containing an alumina hydrate is applied to the base layer and then dried to form the surface layer. The pulp composition may be applied by a gate roll coater, size press, bar coater, blade coater, air knife coater, roll coater, brush coater, curtain coater, bar coater, gravure coater, sprayer or the like.

The recording medium of the present invention may be incorporated with an adequate additive, as required, such as paper strength improver, yield improver and coloring agent. The paper strength improvers used in the present invention include cationic improvers, such as cationized starch and dicyandiamide-formalin condensates; and anionic improvers, such as anionic polyacrylamide and anionic colloidal silica. They may be used either individually or in combination. Moreover, it may be size-pressed with starch or the like, or calender-rolled to improve surface smoothness.

The recording medium of the present invention preferably has an ultrasonic wave transmission rate change of 7% or less both in the MD and CD directions, after being rewetted and free-dried. In this range, there can be prevented deformation, wrinkling or cockling when multiple printing is effected at a high speed. It is more preferable that a change in a ratio between the CD direction and the MD direction is 1.4 or less, since curling after printing can be prevented. Desired ultrasonic wave transmission rate change and the ratio between the CD and MD directions after rewetted and free-dried can be secured by reducing drying-caused shrinkage during the medium production process, more concretely by use of a Yankee drier, by increasing tension of the drier canvas, by the use of bulky or cross-linked pulp as the pulp stock, and by increasing temperature gradient in the initial drying zone. The rewetting and free-drying treatments are effected by immersing the sample in pure water kept at 20° C. for 3 hours and then drying the wet sample in a flow of air at 20° C. and 60% RH for 24 hours as described in Japanese Patent Application Laid-Open No. 2-251967.

The back layer, i.e., the layer opposite to the surface layer of the recording medium of the present invention may be watermarked or printed, by which a surface and a back of the recording medium can be easily distinguished, and various types of information, such as a product lot number and printing conditions can be recorded on the recording medium in advance. It may be watermarked or printed with a sign such as bar code, letters or pattern such as, for logotype and product name. These marks may be visible in visible light, or only in ultraviolet, infrared or specially polarized light so that they are invisible in visible light, or only under a magnetic condition or in a magnetic field. The back layer may be watermarked or printed by a known method.

The alumina hydrate used in the present invention is the one of boebmite structure. An alumina hydrate may contain a metallic oxide, such as titanium dioxide or silica, so long as it shows a boebmite structure when analyzed by an X-ray diffractometry. Content of titanium dioxide is preferably 0.01 to 1.00% by weight on the alumina hydrate, to improve absorption of coloring materials without deteriorating an affinity of the layer to water. One example of alumina hydrate of boehmite structure, containing titanium dioxide, is disclosed by Japanese Patent No. 2,714,351. Content of silica is preferably 0.1 to 30% by weight on the alumina hydrate to simultaneously satisfy the requirements of coloristic performance and affinity of the surface layer with the solvent. One example of alumina hydrate of boebmite structure, containing silica, is disclosed by Japanese Patent Application Laid-Open No. 2000-79755. The other metallic oxides used in the present invention include oxides of magnesium, calcium, strontium, barium, zinc, boron, silicon, germanium, tin, lead, zirconium, indium, phosphorus, vanadium, niobium, tantalum, chromium, molybdenum, tungsten, manganese, iron, cobalt, nickel, and ruthenium.

A shape of an alumina hydrate can be measured by a transmission electron microscope for the sample prepared by dropping the alumina hydrate dispersed in water, alcohol or the like onto a collodion membrane. It is generally accepted that alumina hydrates of pseudo-boehmite structure fall into two general categories by shape, cilium shaped and others as described in the above-mentioned literature (Rocek J., et al, Applied Catalysis, vol. 74, pp. 29 to 36, 1991). An alumina hydrate having a shape of cilium or flat plate can be used for the present invention. Shape properties of alumina hydrate (particle shape, diameter and aspect ratio) can be measured by a transmission electron microscope for the sample prepared by dropping the alumina hydrate dispersed in ion-exchanged water or alcohol onto a collodion membrane.

The inventors of the present invention have found that an alumina hydrate having a shape of flat plate is more preferable than the one having a shape of cilium, because of the former's higher dispersibility in water, larger pore volume due to random orientation of alumina hydrate particles when formed an ink-receiving layer, and wider pore radius distribution. The hair bundle shape described in this specification means the shape like a hair bundle, composed of needle-shape alumina hydrate particles agglomerating in contact with each other.

Aspect ratio of the hydrate particle having a shape of flat plate can be determined by the method defined by Japanese Patent Publication No. 5-16015. Aspect ratio is a ratio of particle diameter to its thickness, where diameter is defined as that of circle having the area equivalent to that of a projected particle, analyzed by a microscope or electron microscope. Slenderness ratio is a ratio of the major diameter to minor diameter of the flat plane, as determined in a manner similar to that for aspect ratio. Aspect ratio of a hair bundle shape can be determined by assuming that each of the needle-shape particles constituting the bundle is cylindrical, to find its diameters at the top and bottom circles and length, and ratio of its length to its diameter. The most preferable alumina hydrate shape has an average aspect ratio of 3 to 10 and an average particle length of 1 to 50 nm for both flat plate and hair bundle shapes. Within the above range of the aspect ratio, a porous structure having a wide pore radius distribution can be easily formed, since a sufficient gap between the particles can be formed, when forming an ink-receiving layer or incorporating it in the fibrous material. At the same time, the porous structure can have a large pore volume, when the average particle diameter or length is in the above range.

The alumina hydrate for the recording medium of the present invention preferably has a BET specific surface area of 70 to 300 $m^2/g$. The printed image may become turbid white or be insufficient in resistance to water, when the specific surface area is below 70 $m^2/g$. When it is above 300 $m^2/g$, on the other hand, powder drop-off may be accelerated. BET specific surface area, pore radius distribution and pore volume of the alumina hydrate can be determined by the nitrogen absorption·desorption method.

The crystal structure of the alumina hydrate incorporated in the recording medium of the present invention can be determined by the common X-ray diffractometry. The recording medium incorporated with an alumina hydrate is set on a measurement cell, and analyzed to measure the peak of the (020) plane appearing at a diffraction angle 2θ of 14 to 15°, and an interplaner spacing of the (020) plane can be obtained by the Bragg equation and a crystallite size in the direction perpendicular to the (010) plane by the Scherrer equation, from the peak diffraction angle 2θ and a half-width B measured.

The alumina hydrate to be incorporated in the recording medium of the present invention preferably has an interplaner spacing of the (020) plane of from 0.617 nm to 0.620 nm, so as to have a great choice of coloring agents such as dyes and a high optical density of the print even though either a hydrophobic or hydrophilic coloring agent is used, and to suppress an occurrence of bleeding, beading or repelling. Optical density and printed dot diameter can be uniform, irrespective of coloring agent type, even when a hydrophilic and hydrophobic agent are simultaneously used. Moreover, optical density of the print and printed dot diameter remain unchanged even with an ink containing a hydrophilic or hydrophobic material, and bleeding, beading or repelling is difficult to occur. Crystallite size in the direction perpendicular to the (010) plane is preferably in a range of from 6.0 to 10.0 nm. In this range, the recording medium becomes good in an ink absorptivity and coloring agent absorptivity, less in powder drop-off. These desirable interplaner spacing and crystallite size of an alumina hydrate can be realized by, for example, a method described in Japanese Patent Application Laid-Open No. 9-99627.

Degree of crystallinity of the alumina hydrate incorporated in the recording medium can be similarly determined by an X-ray diffractometry. The recording medium incorporated with an alumina hydrate is set on a measurement cell, after being powdered, and analyzed to measure peak intensity at a diffraction angle 2θ=10° and that of the peak of the (020) plane appearing at a diffraction angle 2θ of 14 to 15°, and a degree of crystallinity can be obtained from the ratio of peak intensity at 2θ=10° to that of the (020) plane.

The degree of crystallinity of the alumina hydrate to be incorporated in the recording medium is preferably in a range of from 15 to 80. In this range, a good ink absorptivity can be improved and in addition to that water fastness of the printed image can be also enhanced. The desirable degree of crystallinity can be realized by, e.g., a method described in Japanese Patent Application Laid-Open No. 8-132731.

The pore structure of the aluminum hydrate to be incorporated in the recording medium may be optionally selected from one or more of the following preferred three structures.

The alumina hydrate of the first pore structure, used in the present invention, has an average pore radius of from 2.0 to 20.0 nm and a half width of pore radius distribution of 2.0 to 15.0 nm, where the average pore diameter is described in Japanese Patent Application Laid-Open Nos. 51-38298 and 4-202011, and the half width of pore radius distribution is defined as a width of pore radii appearing at a frequency half that of the average pore radius.

Dyes in the ink are selectively absorbed by the pores of specific radius, as discussed by Japanese Patent Application Laid-Open Nos. 4-267180 and 5-16517, and the hydrate of the above crystal structure secures a great choice of coloring agents, efficiently suppresses an occurrence of bleeding, beading or repelling, even when a hydrophilic or hydrophobic coloring agent is used, and also secures uniform optical density and printed dot diameter. The desirable crystal structure can be realized by, e.g., a method described in Japanese Patent No. 2,714,352.

The alumina hydrate of the second pore structure, used in the present invention, has a peak in a radius range of 10.0 nm or less in the pore radius distribution and another peak in a radius range of from 10.0 to 20.0 nm. The larger pores having a radius of from 10.0 to 20.0 nm absorb the solvent component of the ink, and the smaller pores having a radius of 10.0 nm or less absorb the coloring agent component such as coloring agent of the ink, so that both absorption of the coloring agent component and absorption of the solvent component are accelerated. The peak appearing in a radius range of 10.0 nm or less preferably appears in a range of from 1.0 to 6.0 nm to accelerate absorption of the coloring agent component. The peak appearing in a radius range of 10.0 nm or less preferably has a pore volume ratio (volume ratio of the peak 2) of 0.1 to 10% on the total pore volume, to simultaneously satisfy ink absorptivity and coloring agent fixation, more preferably 1 to 5% to accelerate ink absorption and coloring agent absorption. The alumina hydrate of the above crystal structure can be produced by, e.g., a method described in Japanese Patent No. 2,714,350. Another method to produce the above hydrate is of mixing an alumina hydrate having a peak in a radius range of 10.0 nm or less with a hydrate having a peak in a radius range of from 10.0 to 20.0 nm.

The alumina hydrate of the third pore structure, used in the present invention, has a largest peak in a radius range of from 2.0 to 20.0 nm in the pore radius distribution, to simultaneously satisfy ink absorptivity and coloring agent absorption, improve transparency of the alumina hydrate, and prevent the printed image from becoming turbid white; more preferably in a radius range of from 6.0 to 20.0 nm, to prevent an occurrence of bleeding, repelling or uneven coloring, irrespective of ink type used, for example, an ink containing pigment as the coloring agent, dye, and dye and pigment, and mixed inks; and most preferable radius range is from 6.0 to 16.0 nm. In this range, there is caused no variation in color tone resulting from difference in color agent concentration, when 3 or more types of coloring agents of different coloring agent concentration are used. The alumina hydrate of the above crystal structure can be produced by, e.g., a method described in Japanese Patent Application Laid-Open No. 9-6664.

Total pore volume of the alumina hydrate is preferably in a range of from 0.4 to 1.0 $cm^3/g$, to secure a good ink absorptivity and prevent deterioration of color tone, when multi-color printing is effected; more preferably 0.4 to 0.6 $cm^3/g$, to prevent an occurrence of powder drop-off and bleeding of the printed image. Moreover, it is preferable that pore volume of the hydrate particles having a radius ranging from 2.0 to 20.0 nm accounts for at least 80% of the total pore volume, since the printed image can be prevented from becoming turbid white.

Agglomeration of the alumina hydrate particles is another preferred embodiment. The agglomerated hydrate preferably has a particle diameter of 0.5 to 50 $\mu$m and a ratio of a BET specific surface area to a pore volume of 50 to 500 $m^2/l$. In this range, a number of absorption sites of the alumina particles are exposed to prevent an occurrence of beading irrespective of atmosphere (temperature and humidity) in which printing is effected. The agglomerated particles of the above crystal structure can be produced by, for example, a method described in Japanese Patent Application Laid-Open No. 8-174993.

The alumina hydrate for the present invention may be incorporated with an additive. Such an additive may be optionally selected, as required, from the group consisting of various metallic oxides, salts of divalent or higher valent metals, and cationic organic compounds. The metal oxides used in the present invention include oxides such as silica, silica-alumina, boria, silica-boria, magnesia, silica-magnesia, titania, zirconia, zinc oxide and the like, and a hydroxide. The salts of divalent or higher valent metals used in the present invention include calcium carbonate, barium sulfate, calcium nitrate, halides such as magnesium chloride, calcium bromide, calcium nitrate, calcium iodide, zinc chloride, zinc bromide and zinc iodide, kaoline and talc. The cationic organic compounds used in the present invention include quaternary ammonium salts, polyamines and alkyl amines. Content of the additive(s) is preferably 20% by weight or less on the alumina hydrate.

In the present invention, there may be used an alumina hydrate subjected to a coupling treatment, using one or more coupling agents selected from the group consisting of those based on silane, titanate, aluminum and zirconium. Use of an alumina hydrate hydrophobicized with a coupling agent is preferable, because the color density of the printed image can be made higher and also improved clear image can be obtained. Treatment of the hydrate with a coupling agent within a range of from 0.1 to 30% of the total hydrate surface enhances coloristic performance without deteriorating ink absorptivity. The coupling treatment can be effected by, for example, a method described in Japanese Patent Application Laid-Open No. 9-76628.

The recording medium of the present invention may be incorporated with an additive, as required, in addition to an alumina hydrate, such as pigment dispersant, thickening agent, pH modifier, lubricant, fluidity modifier, surfactant, antifoaming agent, water resistance improver, foam-controlling agent, releasing agent, foaming agent, penetrant, coloring dye, fluorescent brightening agent, ultraviolet ray absorber, antioxidant, preservative and antifungal agent. The water resistance improver may be optionally selected from the known ones, for example, halogenated quaternary ammonium salts and polymers of quaternary ammonium salts.

For production of the recording medium of the present invention, a compound capable of cross-linking metallic alkoxide or hydroxyl group may be added to a liquid dispersed with an alumina hydrate. The recording medium produced by this method can prevent an occurrence of bleeding or beading, even when printed with a highly penetrative ink containing a large quantity of surfactant.

The method for preparation of a dispersion dispersed with an alumina hydrate may be optionally selected from the known ones. For the method or apparatus for dispersion, a homomixer or rotary blade type is more preferable than a mill type, e.g., ball mill and sand mill, operating at a higher speed. Shearing stress to be added to the dispersion is preferably in a range of from 0.1 to 100.0 $N/m^2$ (1 to 1,000 $dyn/cm^2$), although varying depending on viscosity, quantity and volume of the dispersion. In this range, its viscosity can be reduced without changing the crystal structure of the alumina hydrate. This type of treatment sufficiently reduces the alumina hydrate particle size, so that number of binding sites between the hydrate and fibers can be increased, and hence an occurrence of powder drop-off can be suppressed. More preferable shearing stress is in a range of from 0.1 to 50.0 $N/m^2$. In this range, the agglomerated alumina hydrate particles can be destroyed without reducing their pore volume, thereby preventing formation of large pores in the recording medium to form minute particles, and hence preventing separation or cracking of the medium when it is folded, and also reducing haze caused by the large particles present in the medium. The most preferable shearing stress is in a range of from 0.1 to 20.0 $N/m^2$, to keep a hydrate/binder mixing ratio in the medium at a constant level, thereby preventing powder drop-off or medium cracking, and also keeping an optical density of the printed dots and dot diameter constant.

Required dispersion time varies depending on quantity and temperature of the dispersion and vessel dimensions, but is preferably 30 hours or less to prevent changes in the crystal structure, more preferably 10 hours or less to control the pore structure in the above-mentioned desired range. Dispersion temperature may be kept at a constant level by an adequate means, for example, cooling or heating. Preferable dispersion temperature is in a range of from 10 to 100° C., although varying depending on dispersing method, and type and viscosity of dispersion. Problems may occur when the dispersion treatment is effected at temperature beyond the above range, for example, insufficient dispersion or agglomeration of the particles at below 10° C., and gelation of the dispersion and transformation of the crystal structure into the amorphous state above 100° C.

The ink for the method of the present invention for producing images comprises a coloring agent (dye or pigment), water-soluble organic solvent and water. The dyes used in the present invention include direct dyes, acid dyes, basic dyes, reactive dyes and water-soluble dyes represented by the one for foods. Any dye may be used so long as it gives an image satisfying required properties, such as fixing performance, coloristic performance, brightness, clearness, stability and fastness to light, when combined with the recording medium of the present invention. The pigments used in the present invention include carbon black or the like. A pigment incorporated with a dispersant, self-dispersing type pigment, and one contained in macrocapsules may be used.

A water-soluble dye is generally used after being dissolved in water or a water-soluble organic solvent. As the solvent component preferably a mixture of water and water-soluble organic solvent is used. Water content in the ink is preferably controlled in range of from 20 to 90% by weight.

The water-soluble solvents used in the present invention include alkyl alcohols having a carbon number of 1 to 4 such as methyl alcohol; amides such as dimethyl formamide; ketones or ketone alcohols such as acetone; ethers such as tetrahydrofuran; polyalkylene glycols such as polyethylene glycol; alkylene glycols having carbon atoms of 2 to 6 such as ethylene glycol; and lower alkyl ethers of polyhydric alcohols such as glycerol, ethyleneglycol methyl ether, of which polyhydric alcohols (such as diethylene glycol) and lower alkyl ethers of polyhydric alcohols (such as triethylene glycol monomethyl ether and triethylene glycol monoethyl ether) are more preferable. Polyhydric alcohols are particularly preferable, because of their function of lubricant to prevent nozzle clogging, which may be caused by separation of the water-soluble dye as a result of evaporation of water in the ink.

The ink for the present invention may be incorporated with a solubilizer. The representative solubilizers are nitrogen-containing heterocyclic ketones, and their object function is to sharply improve solubility of the water-soluble dye in the solvent. For example, the preferable ones include N-methyl-2-pyrrolidone and 1,3-dimethyl-2-imidazolidinone. The ink may be further incorporated with another additive, for example, viscosity modifier, surfactant, surface tension modifier, pH modifier, and resistivity modifier, in order to improve its characteristics.

The method for producing images on the recording medium of the present invention is an ink-jet recording method. Any recording method may be used for the present invention, so long as an ink can be efficiently discharged from a nozzle and applied onto the recording medium of the present invention. One of the preferable ink-jet printing method is the one disclosed by Japanese Patent Application Laid-Open No. 54-59936, where thermal energy is applied to the ink to cause volume change, thereby ejecting the ink by a force due to a state change from the nozzle.

The present invention is described more concretely by Examples, by which the present invention is not limited by no means.

The properties described in this specifications were measured by the following methods.

1. Crystal Structure

The recording medium was analyzed by an X-ray diffractometry, and an interplanar spacing of the (020) plane was determined by the Bragg equation, a crystallite size in the direction perpendicular to the (010) plane was determined by the Scherrer equation, and a degree of crystallinity from the ratio of peak intensity of (020) plane to that at $2\theta=10°$.

2. BET Specific Surface Area, Pore Radius Distribution and Pore Volume

They were determined by the nitrogen absorption·desorption method.

Analyzer: Autosorb 1, available from Quanthachrom Co., Ltd.

3. Content of Titanium Dioxide or Silica

Content of titanium dioxide or silica in an alumina hydrate was determined by the ICP method using an analyzer (SPS4000, trade name, a product of Seiko Denshi) after the alumina hydrate was dissolved in a borate.

4. Particle Shape

Ion-exchanged water dispersed with an alumina hydrate was dropped onto a collodion membrane to prepare the sample, which was analyzed by a transmission electron microscope (H-500, trade name, a product of Hitachi), to determine aspect ratio, diameter and shape of the particles.

5. Changes in Ultrasonic Wave Transmission Rate after Rewetting and Free Drying the Samples Rewetting and free drying were effected by immersing the sample in pure water kept at 20° C. for 3 hours and then drying it in a flow of air at 20° C. and 60% RH for 24 hours. The procedure is described in detail in "Preceding paper for Paper Property Conference," p. 161, 1987, published by TAPPI and in Journal of TAPPI, p. 67, April 1982.

Ultrasonic wave transmission rate of the sample was determined by a tester (Sonic Sheet Tester, trade name, a product of Nomura Shoji), which is in compliance with the specification by ASTM F89-68. The detailed procedure is described in Paper and Pulp Gijutu Kyokai-shi (Journal of the J.TAPPI), p.40, July 1986.

The sample was measured for ultrasonic wave transmission rate before and after the rewetting and free drying treatment in the CD and MD directions, and then change rate is obtained by the ratio between the rates before and after the treatment for each direction.

6. Liquid Absorption Rate

Liquid absorption rate of the recording medium was determined by a dynamic scanning absorpto meter (KM350-D1, trade name, a product of Kyowa Seiko-sha Co., Ltd.), where the ink was brought into contact with the recording medium sample for varying a contact time within a range of from 2 milliseconds to 10 seconds. The liquid absorption curve with a quantity of liquid transferred plotted in a vertical axis against a square root of contact time in a horizontal axis was prepared. Wetting time was defined as a contact time span from the point at which the curve started to sharply rise, and an absorption coefficient was determined from the slope while the liquid was absorbed. Two types of liquids were used, ion-exchanged water and water-based ink having the following composition. Absorption coefficients of the surface and base layers were respectively measured, and a ratio of an absorption coefficient of the base layer to that of the surface layer was obtained.

Composition of the water-based ink (100 parts in total)

| | |
|---|---|
| Dye (C.I. Food Black 2) | 3 parts |
| Surfactant (Surfynol 465, trade name, a product of Nisshin Kagaku) | 1 part |
| Diethylene glycol | 5 parts |
| Polyethylene glycol | 10 parts |
| Ion-exchanged water | Balance |

7. Fluffing

Fluffing was observed by scratching the sample surface 10 times by a nail. The sample was ranked as A when it showed no fluffing, B when it showed slightly roughened surface and C when it showed apparent fluffing.

8. Powder Drop-off, When the Sample Was Cut

The sample was cut into a 10 mm square and powder drop-off at its cut sections was observed. The sample was ranked as A when no powder drop-off was observed and C when powder drop-off was observed.

9. Powder Drop-off, When the Sample Was Folded

The sample was folded at the center and then unfolded, and then powder drop-off was observed. The sample was ranked as A when it showed no powder drop-off after having folded/unfolded 5 times, B when it showed no powder drop-off after having folded/unfolded up to 3 times and C when it showed powder drop-off.

10. Curling

The sample was cut into a specimen of 297 mm by 210 mm, and was allowed to stand in 3 different atmospheres, 30° C./80% RH, 20° C./45% RH and 5° C./10% RH, respectively, for 24 hours, and set on a flat table in each atmosphere to measure warpage by a height gauge. It was ranked as A when its warpage was 1 mm or less, B when it was 3 mm or less and C when it was above 3 mm.

11. Tacking

The sample was allowed to stand in 3 different atmospheres, 30° C./80% RH, 20° C./45% RH and 5° C./10% RH, respectively, for 24 hours, and measuring was conducted in each atmosphere. It was ranked as A when it did not stick to the finger touched thereto and C when it stuck to the finger.

12. Printing Characteristics

The samples were printed using the following 3 types of printers. The sample size was 297 mm by 210 mm when printed by Printer (a) and (b), and 99 mm by 150 mm when printed by Printer (c). Printer (a): DJ720C (trade name, a product of Hewlett Packard Co., Ltd.) in which printing is conducted with small ink droplets, and pigment ink for black color and dye inks for Y (yellow), M (magenta) and C (cyan) colors are used. Printer (b): BJC250 (trade name, a product of Canon Corp.) in which a lot of light-color ink can be ejected into the medium using a photocartridge. Printer (c): Card Printer P-400CII (trade name, a product of Canon Aptex Inc.) which performs superhigh-speed printing, using a line head.

12-1) Ink Absorptivity

The samples were solid printed using the above Printers with a single-color ink up to 4-color inks, and a drying state of the ink on the sample surface was measured by putting a finger on the print to determine the ink absorptivity. Quantity of the ink at solid printed portions with the single-color ink was set to 100%. The sample was ranked as AA when the ink was not sticky at an ink quantity of 300% (mixed with 3 color inks), A when it was not sticky at an ink quantity of 200% (mixed with 2 color inks), B when it was not sticky at a quantity of 100%, and C when it was sticky at an ink quantity of 100%.

12-2) Optical Density of Image

The sample was solid printed using Printer (c) with a single color of Y, M, C or Bk (black) at an ink quantity of 100%, and an optical density of image was measured by a Macbeth reflecting density meter RD-918.

12-3) Solid Printing Uniformity, Bleeding, Beading, Repelling, and Strike-through The sample was solid printed with single- or multi-colors using the 3 Printers, and solid printing uniformity, bleeding, beading, repelling, and strike-through on the medium surface were visually observed. The sample was ranked as A when density of the solid printing section was uniform, and C when it showed blanks or uneven density. It was ranked as A when it showed no bleeding of the coloring agent from the solid printed section, and C when it showed bleeding. It was ranked as A when it showed no beading or repelling at the solid printing section, and C when it showed beading or repelling. The back surface of the sample was visually observed for strike-through of the coloring agent. It was ranked as A when it showed no strike-through, and C when it showed strike-through.

12-4) Difference Between Pigment Ink and Dye Ink in Color Tone

The sample was solid printed using the 3 Printers above with a black ink with 100% duty and the difference between the pigment ink and dye ink in color tone at the solid printed section were visually observed. It was ranked as A when there was no difference in color tone among the prints by the 3 printers, B when there was no difference in color tone between the prints by the printer (a) and another printer, and C when there was a difference.

12-5) Fixing Performance

The sample was solid printed using Printer (a) with a black ink with 100% duty, and the fixing performance was assessed by rubbing the printed section with a finger. It was ranked as A when the finger was not stained with the coloring agent, and C when it was stained. The sample was printed with one dot by Printer (a) with a single-color of Y, M, C and Bk inks, respectively. Diameter of the dot was measured microscopically.

12-6) Print Density and Change in Color Tone

The sample was solid printed using the 3 Printers with patterns with 128 levels of densities, where each single-color ink was used in a range of from 0 to 100%, and color tones at each density for each color were visually observed. The sample was ranked as AA when all of the 4 colors showed the same color tone, irrespective of density, A when the 3 colors showed the same color tone, B when the 2 colors showed the same color tone, and C when the 4 colors were different from each other in color tone.

12-7) Curling after Printing

The sample was cut into a specimen of 297 mm by 210 mm, which was solid printed with an 100% duty over the entire surface using the printers (a) and (b). The sample was set on a flat table and warpage by a height gauge was measured. It was ranked as A when its warpage was 1 mm or less, B when it was 3 mm or less and C when it was above 3 mm.

12-8) Tacking after Printing

The sample was solid printed with 100% duty over the entire surface using the 3 printers. It was ranked as A when it did not stick to the finger touched thereto and C when it stuck to the finger.

12-9) Powder Drop-off after Printing

A total of 10 samples, placed one on another, were passed one by one through the 3 Printers, respectively, and powder drop-off was visually observed. The sample was ranked as A when there was no powder drop-off, and C when there was powder drop-off.

12-10) Stickiness after Printing

A total of 10 samples were printed continuously by the 3 Printers, respectively, and the printed samples were placed one on another. The sample was ranked as A when each did not stick to another, and C when one stuck to another.

12-11) Change in Surface State after Printing

The sample was printed by the 3 Printers, respectively, and the printed section was visually observed. It was ranked as A when there was no change on the printed section, and C when there was a change, e.g., swelling.

12-12) Cockling, Wrinkling and Deformation

The sample was printed by the 3 Printers, respectively, and deformation or the like was visually observed. It was ranked as A when there was no deformation or the like on the printed sample, and C when there was wrinkling, deformation or cockling.

EXAMPLE 1

Commercially available LBKP was beaten by a double disk refiner to a Canadian Standard Freeness (CSF) of 300 ml to prepare the beaten pulp stock (A) for the base layer. The same LBKP was beaten by the same machine to a CSF of 450 ml, to prepare the beaten pulp stock (B). The beaten pulp stock (B) was incorporated with an alumina hydrate of boehmite structure (Alumina Hydrate A), described in Example 1 of Japanese Patent Application Laid-Open No. 9-99627 at 10% by weight in the terms of dried solid on the pulp stock to prepare the pulp stock for the surface layer.

The two-layer paper-making was effected with the above pulp stocks so as to obtain the base and surface layers having a basis weight of 60 and 20 g/m$^2$, respectively, using a multi-layer paper-making machine equipped with a multi-layer head box. The paper thus produced was treated by calendering having a line pressure of 20 kg/cm after drying to prepare the alumina-incorporated multi-layer recording medium having a basis weight of 80 g/m$^2$. It was comparable to plain paper in touch. Properties of the recording medium were determined by the above-mentioned methods. The results are given in Table 2.

EXAMPLE 2

A beaten pulp slurry having a CSF of 300 ml was milled by abrasive grinder, in a manner described in Example 1 of Japanese Patent Application Laid-Open No. 8-284090. It was then treated by a high-pressure homogenizer to prepare the beaten stock (C), composed of cellulose fibrils.

A mixture of the beaten stocks (C) and (B) in a ratio of 80/20 (as dried solid) was prepared, and incorporated with the Alumina Hydrate A at 10% by weight (as dried solid) on the pulp stock, to prepare the pulp stock for the surface layer.

The above pulp stock for the surface layer and beaten pulp stock (A) for the base layer were processed by the same machine and method as used for Example 1 to prepare a multi-layer paper of a two-layer constitution, where the base and surface layers had a basis weight of 60 and 20 g/m$^2$, respectively. The paper thus produced was surface-treated by calendering in a manner similar to that for Example 1 to prepare the alumina-incorporated multi-layer recording medium having a basis weight of 80 g/m$^2$. It was comparable to plain paper in touch. Properties of the recording medium were determined by the above-mentioned methods. The results are given in Table 2.

EXAMPLE 3

Commercially available bleached sulfite pulp from broadleaf trees was beaten by the same machine as used for Example 1 to a CSF of 450 ml to prepare the beaten stock (D).

A mixture of the beaten stocks (D) and (B) in a ratio of 60/40 (as dried solid) was prepared, and incorporated with the Alumina Hydrate A at 10% by weight (as dried solid) on the pulp stock to prepare the pulp stock for the surface layer.

The above pulp stock for the surface layer and beaten pulp stock (A) for the base layer were processed by the same machine and method as used for Example 1 to prepare a multi-layer paper of a two-layer constitution, where the base and surface layers had a basis weight of 60 and 20 g/m$^2$, respectively. The paper thus produced was surface-treated by calendering in a manner similar to that for Example 1 to prepare the alumina-incorporated multi-layer recording medium having a basis weight of 80 g/m$^2$. It was comparable to plain paper in touch. Properties of the recording medium were determined by the above-mentioned methods. The results are given in Table 2.

EXAMPLE 4

Cross-linked pulp (High Bulk Additive, trade name, a product of Weyerhauser Paper Co., Ltd.) as bulky cellulosic fibers of twisted structure was treated to prepare the beaten stock (E).

A mixture of the beaten stocks (E) and (B) containing the former at 3% by weight (as dried solid) was prepared, and incorporated with the Alumina Hydrate A at 10% by weight (as dried solid) on the pulp stock to prepare the pulp stock for the surface layer.

The above pulp stock for the surface layer and beaten pulp stock (A) for the base layer were processed by the same machine and method as used for Example 1 to prepare a multi-layer paper of a two-layer constitution, where the base and surface layers had a basis weight of 60 and 20 g/m$^2$, respectively. The paper thus produced was surface-treated by calendering in a manner similar to that for Example 1, to prepare the alumina-incorporated multi-layer recording medium having a basis weight of 80 g/m$^2$. It was comparable to plain paper in touch. Properties of the recording medium were determined by the above-mentioned methods. The results are given in Table 2.

EXAMPLE 5

An aqueous dispersion (solid content: 1.5% by weight) with a sodium salt of fibrous carboxymethyl cellulose (available from Nichirin Chemical Industries Ltd.) having a esterification degree of 0.43 and saturation degree with base of 82% was incorporated with 2.0% by weight (on the sodium salt) of polyamine resin (Sumirez Resin FR-2P, trade name, a product of Sumitomo Chemical Co., Ltd.), and stirred to prepare a highly absorptive resin.

A mixture of the beaten stock (A) and the above highly absorptive resin in a ratio of 95/5 (as dried solid) was prepared as the pulp stock for the base layer.

The above pulp stock for the base layer and the same pulp stock for the surface layer as prepared by Example 1 were processed by the same machine and method as used for Example 1 to prepare a multi-layer paper of a two-layer constitution, where the base and surface layers had a basis weight of 60 and 20 g/m$^2$, respectively. The paper thus produced was surface-treated by calendering in a manner similar to that for Example 1 to prepare the alumina-incorporated multi-layer recording medium having a basis weight of 80 g/m$^2$. It was comparable to plain paper in touch. Properties of the recording medium were determined by the above-mentioned methods. The results are given in Table 2.

EXAMPLE 6

A mixture of the beaten stock (A) and beaten stock (E) prepared by Example 4 in a ratio of 65/35 (as dried solid) was prepared as the pulp stock for the base layer.

The above pulp stock for the base layer and the same pulp stock for the surface layer as prepared by Example 1 were processed by the same machine and method as used for Example 1 to prepare a multi-layer paper of a two-layer constitution, where the base and surface layers had a basis weight of 60 and 20 g/m$^2$, respectively. The paper thus produced was surface-treated by calendering in a manner similar to that for Example 1 to prepare the alumina-incorporated multi-layer recording medium having a basis weight of 80 g/m$^2$. It was comparable to plain paper in touch. Properties of the recording medium were determined by the above-mentioned methods. The results are given in Table 2.

EXAMPLE 7

An ozone-containing gas was blown into an aqueous dispersion of commercially available bleached kraft pulp from coniferous trees, in accordance with the method disclosed in Example 1 of Japanese Patent Application Laid-Open No. 8-667. The dispersion was dried, unraveled, dried again under heating and put into a blender, where the pulp blocks were divided into fine individual fibers to prepare the beaten stock (F) composed of fluffed cellulose.

A mixture of the beaten stocks (A) and (F) in a ratio of 65/35 (as dried solid) was prepared as the pulp stock for the base layer.

The above pulp stock for the base layer and the same pulp stock for the surface layer as prepared by Example 1 were processed by the same machine and method as used for Example 1 to prepare a multi-layer paper of a two-layer constitution, where the base and surface layers had a basis weight of 60 and 20 g/m$^2$, respectively. The paper thus produced was surface-treated by calendering in a manner similar to that for Example 1 to prepare the alumina-incorporated multi-layer recording medium having a basis weight of 80 g/m$^2$. It was comparable to plain paper in touch. Properties of the recording medium were determined by the above-mentioned methods. The results are given in Table 2.

EXAMPLE 8

Commercially available mercerized kraft pulp was beaten by the same machine as used for Example 1 to a CSF of 740 ml to prepare the beaten pulp stock (G). A mixture of the beaten stocks (A) and (G) in a ratio of 65/35 (as dried solid) was prepared as the pulp stock for the base layer.

The above pulp stock for the base layer and the same pulp stock for surface layer as prepared by Example 1 were processed by the same machine and method as used for Example 1 to prepare a multi-layer paper of a two-layer constitution, where the base and surface layers had a basis weight of 60 and 20 g/m$^2$, respectively. The paper thus produced was surface-treated by calendering in a manner similar to that for Example 1 to prepare the alumina-incorporated multi-layer recording medium having a basis weight of 80 g/m$^2$. It was comparable to plain paper in touch. Properties of the recording medium were determined by the above-mentioned methods. The results are given in Table 2.

EXAMPLE 9

An alumina hydrate of boehmite structure (Alumina Hydrate B), described in Example 2 of Japanese Patent Application Laid-Open No. 9-99627 was added to the beaten stock (B) to 10% by weight (as dried solid) to prepare the pulp stock for the surface layer.

The beaten stock (A) for the base layer and the above pulp stock for surface layer were processed by the same machine and method as used for Example 1 to prepare a multi-layer paper of a two-layer constitution, where the base and surface layers had a basis weight of 60 and 20 g/m$^2$, respectively. The paper thus produced was surface-treated by calendering in a manner similar to that for Example 1 to prepare the alumina-incorporated multi-layer recording medium having a basis weight of 80 g/m$^2$. It was comparable to plain paper in touch. Properties of the recording medium were determined by the above-mentioned methods. The results are given in Table 2.

EXAMPLE 10

An alumina hydrate of boehmite structure with pores having a radius of 2.0 to 20.0 nm accounting for at least 80% of the total pore volume (Alumina Hydrate C), described in Example 1 of Japanese Patent Application Laid-Open No. 9-66664 was added to the beaten stock (B) to 10% by weight (as dried solid) to prepare the pulp stock for the surface layer.

The beaten stock (A) for the base layer and the above pulp stock for surface layer were processed by the same machine and method as used for Example 1 to prepare a multi-layer paper of a two-layer constitution, where the base and surface layers had a basis weight of 60 and 20 g/m$^2$, respectively. The paper thus produced was surface-treated by calendering in a manner similar to that for Example 1 to prepare the alumina-incorporated multi-layer recording medium having a basis weight of 80 g/m$^2$. It was comparable to plain paper in touch. Properties of the recording medium were determined by the above-mentioned methods. The results are given in Table 2.

EXAMPLE 11

An alumina hydrate of boehmite structure containing titanium dioxide (Alumina Hydrate D), described in Example 3 of Japanese Patent Application Laid-Open No. 9-99627 was added to the beaten stock (B) to 10% by weight (as dried solid) to prepare the pulp stock for the surface layer.

The beaten stock (A) for the base layer and the above pulp stock for surface layer were processed by the same machine and method as used for Example 1 to prepare a multi-layer paper of a two-layer constitution, where the base and surface layers had a basis weight of 60 and 20 g/m$^2$, respectively. The paper thus produced was surface-treated by calendering in a manner similar to that for Example 1, to prepare the alumina-incorporated multi-layer recording medium having a basis weight of 80 g/m$^2$. It was comparable to plain paper in touch. Properties of the recording medium were determined by the above-mentioned methods. The results are given in Table 2.

EXAMPLE 12

Aluminum dodeoxide was prepared in accordance with the method described in U.S. Pat. No. 4,242,271, and mixed with ion-exchanged water and orthosilicate. The mixed solution was stirred in a reactor vessel, to hydrolyze aluminum dodeoxide, under the following conditions and aluminum dodeoxide/orthosilicate mixing ratio. The same weight as that of aluminum dodeoxide in ion-exchanged water was used.

Hydrolysis temperature: 110° C.
Hydrolysis time: 30 minutes
Mixing ratio: 8.45
(The Mixing Ratio Was Parts by Weight of the Silicate Per 100 Parts by Weight of the Alkoxide)

The alumina hydrate suspension was spray-dried at an inlet temperature of 280° C. to prepare the silica-containing alumina hydrate powder. It had a boehmite structure, composed of the particles of flat plate shape, and the following properties:

Silica content: 1.0% by weight
Average particle size: 27.1 nm
Aspect ratio: 6.1
Degree of crystallinity: 53

The alumina hydrate of boehmite structure having a silica content of 1.0% by weight and crystallinity degree of 53 (Alumina Hydrate E) was added to the beaten stock (B) to 10% by weight (as dried solid) to prepare the pulp stock for the surface layer.

The beaten stock (A) for the base layer and the above pulp stock for the surface layer were processed by the same machine and method as used for Example 1 to prepare a multi-layer paper of a two-layer constitution, where the base and surface layers had a basis weight of 60 and 20 g/m$^2$, respectively. The paper thus produced was surface-treated by calendering in a manner similar to that for Example 1 to prepare the alumina-incorporated multi-layer recording medium having a basis weight of 80 g/m$^2$. It was comparable to plain paper in touch. Properties of the recording medium were determined by the above-mentioned methods. The results are given in Table 2.

EXAMPLE 13

An alumina hydrate of boehmite structure having a crystallinity degree of 32.2 (Alumina Hydrate F), described in Example 2 of Japanese Patent Application Laid-Open No. 8-132731 was added to the beaten stock (B) to 10% by weight (as dried solid) to prepare the pulp stock for the surface layer.

The beaten stock (A) for the base layer and the above pulp stock for surface layer were processed by the same machine and method as used for Example 1 to prepare a multi-layer paper of a two-layer constitution, where the base and surface layers had a basis weight of 60 and 20 g/m$^2$, respectively. The paper thus produced was surface-treated by calendering in a manner similar to that for Example 1, to prepare the alumina-incorporated multi-layer recording medium having a basis weight of 80 g/m$^2$. It was comparable to plain paper in touch. Properties of the recording medium were determined by the above-mentioned methods. The results are given in Table 2.

EXAMPLE 14

The alumina hydrate pigment B, described in Examples of Japanese Patent Application Laid-Open No. 8-174993 was agglomerated in accordance with the method described in Example 2 of the above specification using ammonia water, to prepare the agglomerated alumina hydrate particles (Alumina Hydrate G).

The Alumina Hydrate G was added to the beaten stock (B) to 10% by weight (as dried solid) to prepare the pulp stock for the surface layer.

The beaten stock (A) for the base layer and the above pulp stock for the surface layer were processed by the same machine and method as used for Example 1 to prepare a multi-layer paper of a two-layer constitution, where the base and surface layers had a basis weight of 60 and 20 g/m$^2$, respectively. The paper thus produced was surface-treated by calendering in a manner similar to that for Example 1 to prepare the alumina-incorporated multi-layer recording medium having a basis weight of 80 g/m$^2$. It was comparable to plain paper in touch. Properties of the recording medium were determined by the above-mentioned methods. The results are given in Table 2.

EXAMPLE 15

An alumina hydrate treated with a coupling agent, in accordance with the method described in Example 1 of Japanese Patent Application Laid-Open No. 9-76628, was prepared (Alumina Hydrate H).

The Alumina Hydrate H was added to the beaten stock (B) to 10% by weight (as dried solid) to prepare the pulp stock for the surface layer.

The beaten stock (A) for the base layer and the above pulp stock for surface layer were processed by the same machine and method as used for Example 1 to prepare a multi-layer paper of a two-layer constitution, where the base and surface layers had a basis weight of 60 and 20 g/m$^2$, respectively. The paper thus produced was surface-treated by calendering in a manner similar to that for Example 1 to prepare the alumina-incorporated multi-layer recording medium having a basis weight of 80 g/m$^2$. It was comparable to plain paper in touch. Properties of the recording medium were determined by the above-mentioned methods. The results are given in Table 2.

EXAMPLE 16

Commercially available LBKP was beaten by the same machine and method as used for Example 1 to a CSF of 350 ml, to prepare the beaten pulp stock (H) for the back layer.

The same beaten stocks as used for Example 1 and the above pulp stock for the back layer were processed by the same multi-layer paper-making machine as used for Example 1 to prepare a three-layer paper, where the base, surface and back layers had a basis weight of 60, 20 and 20 g/m$^2$, respectively. The paper thus produced was treated by calendering having a line pressure of 20 kg/cm, to prepare the alumina-incorporated multi-layer recording medium having a basis weight of 100 g/m$^2$. It was comparable to plain paper in touch. Properties of the recording medium were determined by the above-mentioned methods. The results are given in Table 2.

EXAMPLE 17

The same pulp stocks for the surface and base layers as used for Example 1 were processed by the same multi-layer paper-making machine as used for Example 1 to prepare a two-layer paper, so as to obtain the base and surface layers having a basis weight of 60 and 20 g/m$^2$, respectively. The machine was equipped with a screen with a watermark pattern in its wire section, which was set in such a way to be in contact with the back layer. The three-layer paper thus produced was dried and treated by calendering having a line pressure of 20 kg/cm to prepare the alumina-incorporated multi-layer recording medium having a basis weight of 80 g/m$^2$. It was further surface-treated by calendering in a manner similar to that for Example 1 to prepare the alumina-incorporated multi-layer recording medium having a basis weight of 80 g/m$^2$. It was comparable to plain paper in touch. Properties of the recording medium were determined by the above-mentioned methods. The results are given in Table 2.

EXAMPLE 18

The recording medium prepared by Example 1 was printed, on its back side (i.e., the side opposite to the surface layer), with a bar code pattern using an offset printing machine (available from A B Dick in U.S.A.) and an ink (F Gloss Ink #85, trade name, a product of Dainippon Ink & Chemicals, Inc.). The printed pattern could be visually observed. No change was observed on the surface layer, and the medium was comparable in touch and had the same properties as the media prepared by Examples 1 to 16.

EXAMPLE 19

The recording medium prepared by Example 1 was printed, on its back side (i.e., the side opposite to the surface layer), with a bar code pattern using an offset printing machine (available from A B Dick in U.S.A.) and a commercially available magnetic ink. The magnetically printed pattern could be observed by a reader. No change was observed on the surface layer, and the medium was comparable in touch and had the same properties as the media prepared by Examples 1 to 16.

EXAMPLE 20

The recording medium prepared by Example 1 was printed, on its back side (i.e., the side opposite to the surface layer), with a bar code pattern using an offset printing machine (available from A B Dick in U.S.A.) and a commercially available infrared ink. The printed pattern could not be observed visually but observed by an infrared ray reader. No change was observed on the surface layer, and the medium was comparable in touch and had the same properties as the media prepared by Examples 1 to 16.

EXAMPLE 21

The same beaten stock (A) as used for Example 1 was made into paper using a TAPPI standard sheet former to prepare the base layer having a basis weight of 60 g/m$^2$. Using the same beaten stock (B) as used for Example 1, the base layer was coated, by bar coating, with the surface layer, so as to have a basis weight of 20 g/m$^2$. The medium thus prepared was dried under heating at 100° C. in an oven (available from Yamato Kagaku) for 10 minutes. It was then treated by calendering in a manner similar to that for Example 1 to prepare the alumina-incorporated multi-layer recording medium having a basis weight of 80 g/m$^2$. It was comparable to plain paper in touch. Properties of the recording medium were determined by the above-mentioned methods. The results are given in Table 2.

Physical properties of Alumina Hydrates A to H are summarized in Table 1.

TABLE 1

| Alumina hydrate | A | B | C | D | E | F | G | H |
|---|---|---|---|---|---|---|---|---|
| Particle shape | plate | plate | plate | plate | plate | plate | plate | plate |
| Average particle diameter (nm) | 33.0 | 35.0 | 27.2 | 29.0 | 27.1 | 30.0 | 30.5 | 29.5 |
| Aspect ratio | 6.5 | 8.3 | 6.4 | 5.5 | 6.1 | 6.5 | 6.5 (*3) | 5.5 |
| Average pore radius (nm) | 7.0 | 7.0 | 6.7 | 6.0 | 8.2 | — | — | — |
| Half width (nm) | 4.5 | 2.3 | 5.0 | 3.5 | 5.0 | — | — | — |
| Peak 1 in pore size distribution (nm) | 7.0 | 11.0 | 7.0 | 8.0 | 8.1 | — | — | — |
| Peak 2 in pore size distribution (nm) | — | 4.0 | — | — | — | — | — | — |
| Largest peak (nm) | 7.0 | 11.0 | 7.0 | 8.0 | 8.1 | — | — | — |
| Pore volume (cm$^3$/g) | 0.60 | 0.60 | 0.60 | 60 | 0.60 | 0.75 | 0.70 | 0.59 |
| Percentage of volume of pores having a radius of 2.0 to 20.0 nm on the total pore volume | — | — | 90% | — | — | — | (*4) | |
| Volumetric ratio of peak 2 (%) | — | 5 | — | — | — | — | | |
| Interplanar spacing (nm) | 0.618 | 0.619 | 0.618 | 0.618 | — | — | — | — |
| Crystallite size (nm) | 8.0 | 7.0 | 7.5 | 7.5 | — | — | — | — |
| Degree of crystallinity | — | — | — | — | 65 | 31 | — | — |
| Additives | | | | (*1) | (*2) | | | |

*1: Titanium dioxide contained at 0.150% by weight
*2: Silica contained at 1.0% by weight
*3: Agglomerated particle diameter: 26 $\mu$m
*4: specific surface area/pore volume ratio: 104 (m$^2$/ml)

TABLE 2

| Preparation conditions, Measured items | Example 1 | Example 2 | Example 3 | Example 4 | Example 5 |
|---|---|---|---|---|---|
| Ratio of change before and after rewetting/drying | 1.2 | 1.0 | 1.1 | 1.0 | 1.1 |
| Wetting time (ion-exchanged water) | 13 | 10 | 10 | 9 | 13 |
| Wetting time (water-based ink) | 10 | 7 | 7 | 6 | 10 |
| Absorption coefficient (ion-exchanged water) | 5 | 5 | 5 | 5 | 7 |
| Absorption coefficient (water-based ink) | 7 | 7 | 7 | 7 | 9 |
| Base layer/surface layer ratio | | | | | |
| Ion-exchanged water | 1.2 | 1.2 | 1.2 | 1.2 | 1.4 |
| Water-based ink | 1.4 | 1.4 | 1.4 | 1.4 | 1.6 |
| Fluffing | A | A | A | A | A |
| Powder drop-off, when the sample was cut | A | A | A | A | A |
| Powder drop-off, when the sample was folded | A | A | A | A | A |
| Curling | A, A, A | A, A, A | A, A, A | A, A, A | A, A, A |
| Tacking | A, A, A | A, A, A | A, A, A | A, A, A | A, A, A |
| Ink absorptivity (*5) | AA, AA, AA | AA, AA, AA | AA, AA, AA | AA, AA, AA | AA, AA, AA |
| Optical density of image (Bk) | 1.15 | 1.13 | 1.15 | 1.16 | 1.14 |
| (C) | 1.16 | 1.14 | 1.15 | 1.15 | 1.15 |
| (M) | 1.15 | 1.12 | 1.13 | 1.15 | 1.16 |
| (Y) | 1.13 | 1.15 | 1.13 | 1.14 | 1.13 |
| Solid printing uniformity (*5) | A, A, A | A, A, A | A, A, A | A, A, A | A, A, A |
| Bleeding (*5) | A, A, A | A, A, A | A, A, A | A, A, A | A, A, A |

TABLE 2-continued

| | | | | | |
|---|---|---|---|---|---|
| Beading (*5) | A, A, A | A, A, A | A, A, A | A, A, A | A, A, A |
| Repelling (*5) | A, A, A | A, A, A | A, A, A | A, A, A | A, A, A |
| Strike-through | A, A, A | A, A, A | A, A, A | A, A, A | A, A, A |
| Difference between pigment and dye in color tone | A | A | A | A | A |
| Fixing performance | A | A | A | A | A |
| Change in density and color tone (*5) | A, A, A | A, A, A | A, A, A | A, A, A | A, A, A |
| Curling after printing | A | A | A | A | A |
| Tacking after printing | A | A | A | A | A |
| Powder drop-off after printing | A | A | A | A | A |
| Stickiness after printing | A | A | A | A | A |
| Change in surface state after printing (*5) | A, A, A | A, A, A | A, A, A | A, A, A | A, A, A |
| Cockling, deformation or the like after printing (*5) | A, A, A | A, A, A | A, A, A | A, A, A | A, A, A |

| Preparation conditions, Measured items | Example 6 | Example 7 | Example 8 | Example 9 | Example 10 |
|---|---|---|---|---|---|
| Ratio of change before and after rewetting/drying | 1.2 | 1.1 | 1.1 | 1.2 | 1.2 |
| Wetting time (ion-exchanged water) | 13 | 13 | 13 | 13 | 13 |
| Wetting time (water-based ink) | 10 | 10 | 10 | 10 | 10 |
| Absorption coefficient (ion-exchanged water) | 7 | 7 | 7 | 5 | 5 |
| Absorption coefficient (water-based ink) | 9 | 9 | 10 | 7 | 7 |
| Base layer/surface layer area ratio | | | | | |
| Ion-exchanged water | 1.4 | 1.4 | 1.4 | 1.2 | 1.2 |
| Water-based ink | 1.6 | 1.6 | 1.6 | 1.4 | 1.4 |
| Fluffing | A | A | A | A | A |
| Powder drop-off, when the sample was cut | A | A | A | A | A |
| Powder drop-off, when the sample was folded | A | A | A | A | A |
| Curling | A, A, A | A, A, A | A, A, A | A, A, A | A, A, A |
| Tacking | A, A, A | A, A, A | A, A, A | A, A, A | A, A, A |
| Ink absorptivity (*5) | AA, AA, AA | AA, AA, AA | AA, AA, AA | AA, AA, AA | AA, AA, AA |
| Optical density of image (Bk) | 1.16 | 1.15 | 1.13 | 1.14 | 1.13 |
| (C) | 1.12 | 1.14 | 1.14 | 1.14 | 1.14 |
| (M) | 1.12 | 1.14 | 1.15 | 1.15 | 1.13 |
| (Y) | 1.13 | 1.13 | 1.14 | 1.13 | 1.13 |
| Solid printing uniformity (*5) | A, A, A | A, A, A | A, A, A | A, A, A | A, A, A |
| Bleeding (*5) | A, A, A | A, A, A | A, A, A | A, A, A | A, A, A |
| Beading (*5) | A, A, A | A, A, A | A, A, A | A, A, A | A, A, A |
| Repelling (*5) | A, A, A | A, A, A | A, A, A | A, A, A | A, A, A |
| Strike-through | A, A, A | A, A, A | A, A, A | A, A, A | A, A, A |
| Difference between pigment and dye in color tone | A | A | A | A | A |
| Fixing performance | A | A | A | A | A |
| Change in density and color tone (*5) | A, A, A | A, A, A | A, A, A | A, A, A | A, A, A |
| Curling after printing | A | A | A | A | A |
| Tacking after printing | A | A | A | A | A |
| Powder drop-off after printing | A | A | A | A | A |
| Stickiness after printing | A | A | A | A | A |
| Change in surface state after printing (*5) | A, A, A | A, A, A | A, A, A | A, A, A | A, A, A |
| Cockling, deformation or the like after printing (*5) | A, A, A | A, A, A | A, A, A | A, A, A | A, A, A |

| Preparation conditions, Measured items | Example 11 | Example 12 | Example 13 | Example 14 |
|---|---|---|---|---|
| Ratio of change before and after rewetting/drying | 1.2 | 1.2 | 1.2 | 1.2 |
| Wetting time (ion-exchanged water) | 13 | 13 | 13 | 13 |
| Wetting time (water-based ink) | 10 | 10 | 10 | 10 |
| Absorption coefficient (ion-exchanged water) | 5 | 5 | 5 | 5 |
| Absorption coefficient (water-based ink) | 7 | 7 | 7 | 7 |
| Base layer/surface layer area ratio | | | | |
| Ion-exchanged water | 1.2 | 1.2 | 1.2 | 1.2 |
| Water-based ink | 1.4 | 1.4 | 1.4 | 1.4 |
| Fluffing | A | A | A | A |

TABLE 2-continued

| | | | | |
|---|---|---|---|---|
| Powder drop-off, when the sample was cut | A | A | A | A |
| Powder drop-off, when the sample was folded | A | A | A | A |
| Curling | A, A, A | A, A, A | A, A, A | A, A, A |
| Tacking | A, A, A | A, A, A | A, A, A | A, A, A |
| Ink absorptivity (*5) | AA, AA, AA | AA, AA, AA | AA, AA, AA | AA, AA, AA |
| Optical density of image (Bk) | 1.14 | 1.14 | 1.14 | 1.14 |
| (C) | 1.13 | 1.13 | 1.13 | 1.13 |
| (M) | 1.13 | 1.15 | 1.15 | 1.15 |
| (Y) | 1.14 | 1.13 | 1.14 | 1.13 |
| Solid printing uniformity (*5) | A, A, A | A, A, A | A, A, A | A, A, A |
| Bleeding (*5) | A, A, A | A, A, A | A, A, A | A, A, A |
| Beading (*5) | A, A, A | A, A, A | A, A, A | A, A, A |
| Repelling (*5) | A, A, A | A, A, A | A, A, A | A, A, A |
| Strike-through | A, A, A | A, A, A | A, A, A | A, A, A |
| Difference between pigment and dye in color tone | A | A | A | A |
| Fixing performance | A | A | A | A |
| Change in density and color tone (*5) | A, A, A | A, A, A | A, A, A | A, A, A |
| Curling after printing | A | A | A | A |
| Tacking after printing | A | A | A | A |
| Powder drop-off after printing | A | A | A | A |
| Stickiness after printing | A | A | A | A |
| Change in surface state after printing (*5) | A, A, A | A, A, A | A, A, A | A, A, A |
| Cockling, deformation or the like after printing (*5) | A, A, A | A, A, A | A, A, A | A, A, A |

| Preparation conditions, Measured items | Example 15 | Example 16 | Example 21 |
|---|---|---|---|
| Ratio of change before and after rewetting/drying | 1.2 | 1.2 | 1.2 |
| Wetting time (ion-exchanged water) | 13 | 13 | 13 |
| Wetting time (water-based ink) | 10 | 10 | 10 |
| Absorption coefficient (ion-exchanged water) | 5 | 6 | 5 |
| Absorption coefficient (water-based ink) | 7 | 8 | 7 |
| Base layer/surface layer area ratio | | | |
| Ion-exchanged water | 1.2 | 1.2 | 1.2 |
| Water-based ink | 1.4 | 1.4 | 1.4 |
| Fluffing | A | A | A |
| Powder drop-off, when the sample was cut | A | A | A |
| Powder drop-off, when the sample was folded | A | A | A |
| Curling | A, A, A | A, A, A | A, A, A |
| Tacking | A, A, A | A, A, A | A, A, A |
| Ink absorptivity (*5) | AA, AA, AA | AA, AA, AA | AA, AA, AA |
| Optical density of image (Bk) | 1.13 | 1.13 | 1.15 |
| (C) | 1.13 | 1.13 | 1.16 |
| (M) | 1.13 | 1.14 | 1.15 |
| (Y) | 1.14 | 1.15 | 1.14 |
| Solid printing uniformity (*5) | A, A, A | A, A, A | A, A, A |
| Bleeding (*5) | A, A, A | A, A, A | A, A, A |
| Beading (*5) | A, A, A | A, A, A | A, A, A |
| Repelling (*5) | A, A, A | A, A, A | A, A, A |
| Strike-through | A, A, A | A, A, A | A, A, A |
| Difference between pigment and dye in color tone | A | A | A |
| Fixing performance | A | A | A |
| Change in density and color tone (*5) | A, A, A | A, A, A | A, A, A |
| Curling after printing | A | A | A |
| Tacking after printing | A | A | A |
| Powder drop-off after printing | A | A | A |
| Stickiness after printing | A | A | A |
| Change in surface state after printing (*5) | A, A, A | A, A, A | A, A, A |
| Cockling, deformation or the like after printing (*5) | A, A, A | A, A, A | A, A, A |

*5: Results of the samples prepared by the printers (a), (b) and (c)

The present invention brings the following noticeable effects:

(1) Ink absorptivity and coloristic performance can be improved, while a touch feeling of plain paper is kept, because of an alumina hydrate incorporated in the fibrous material.

(2) The alumina hydrate addition effects are increased to give good images even at a small dose, because of the alumina hydrate incorporated only in its surface area.

(3) Occurrence of flooding, bleeding or beading of the ink can be prevented, even when the recording medium is printed by a superhigh-speed printer, such as line printer equipped with a full-line head, because the coloring agents are absorbed in the ink by the surface layer and a solvent component is absorbed in the ink by the base layer.

(4) Strike-through can be prevented without subjecting the base layer to a sizing treatment.

(5) Curling resulting from changed temperature or humidity, and powder drop-off or fluffing resulting from rubbing the surface can be prevented.

What is claimed is:

1. A recording medium of multi-layered structure comprising a base layer and a surface layer provided on at least one side of the base layer, wherein the base layer is mainly comprised of fibrous material made of cellulose pulp, the surface layer comprises an alumina hydrate of a boehmite structure incorporated in fibrous material made of cellulose pulp, and the cellulose pulp of the base layer has a beating degree lower than that of the surface layer, and wherein the alumina hydrate is incorporated only in the surface layer.

2. A three-layered recording medium comprising a base layer, a surface layer and a back layer, wherein the base layer is mainly comprised of fibrous material made of cellulose pulp, the surface layer comprises an alumina hydrate of a boebmite structure incorporated in fibrous material made of cellulose pulp, and the cellulose pulp of the base layer has a beating degree lower than that of the surface layer, wherein the alumina hydrate is incorporated only in the surface layer, and the back layer is provided on the side of the base layer opposite to the surface layer.

3. The recording medium according to claim 1 or 2, wherein the base and surface layers are formed by a multi-layer paper-making process.

4. The recording medium according to claim 1 or 2, wherein the surface layer is formed by applying a pulp dispersion on the base layer.

5. The recording medium according to claim 1 or 2, wherein the base layer has a liquid absorptivity higher than that of the surface layer.

6. The recording medium according to claim 1 or 2, wherein the surface layer has a basis weight of at least 5 $g/m^2$ and occupies 40% by weight or less based on the total weight of the recording medium.

7. The recording medium according to claim 1 or 2, wherein a content of the alumina hydrate of a boebmite structure is 50% by weight or less based on the total weight of the surface layer.

8. The recording medium according to claim 1 or 2, wherein the surface layer further comprises fine cellulose fibrils.

9. The recording medium according to claim 1 or 2, wherein the surface layer further comprises a pulp selected from the group consisting of sulfate pulp, sulfite pulp and soda pulp from broadleaf or coniferous trees.

10. The recording medium according to claim 1 or 2, wherein the surface layer further comprises a bulky or porous cellulose selected from the group consisting of mercerized cellulose, fluffed cellulose and bulky cellulose.

11. The recording medium according to claim 1 or 2, wherein the base layer comprises an absorptive material.

12. The recording medium according to claim 1 or 2, wherein the base layer comprises a bulky or porous cellulose selected from the group consisting of mercerized cellulose, fluffed cellulose and bulky cellulose.

13. The recording medium according to claim 1 or 2, wherein the base layer is not sized.

14. The recording medium according to claim 1 or 2, wherein the recording medium has a wetting time of 15 milliseconds or less and an absorption coefficient of at least 5 $ml/m^2s^{-1/2}$, which is obtained from an absorption curve of the recording medium measured by a dynamic scanning absorpto meter.

15. The recording medium according to claim 1 or 2, wherein change in an ultrasonic wave transmission rate is 7% or less and a ratio of change in the rate in the MD direction to that in the CD direction is 1.4 or less, after rewetting and free-drying treatments.

16. The recording medium according to claim 1 or 2, wherein a back surface of the recording medium is printed with a watermark pattern.

17. The recording medium according to claim 1 or 2, wherein a back surface of the recording medium is printed.

18. A method for producing images by ejecting ink-droplets from orifices and depositing the ink-droplets on a recording medium to conduct printing, wherein the recording medium is a recording medium according to claim 1 or 2.

19. The method for producing images according to claim 18, wherein thermal energy is applied to an ink to eject the ink-droplets.

* * * * *

UNITED STATES PATENT AND TRADEMARK OFFICE

CERTIFICATE OF CORRECTION

PATENT NO. : 6,720,041 B2
APPLICATION NO. : 09/441877
DATED : April 13, 2004
INVENTOR(S) : Hitoshi Yoshino et al.

It is certified that error appears in the above-identified patent and that said Letters Patent is hereby corrected as shown below:

ON THE COVER PAGE:

At (56) References Cited, FOREIGN PATFNT DOCUMENTS
"JP 2714351 B1 9/1995" should read --JP 2714351 B2 9/1995-- and after the last line, --SU 245551 1968-- should be inserted.

IN THE DISCLOSURE:

COLUMN 1:
Line 19, "easiness in" should read --ease of--.
Line 35, "Variety" should read --A variety of--.

COLUMN 3:
Line 2, "kaoline," should read --kaolin,--.
Line 29, "little" should read --suffering--.
Line 30, "suffering" should read --little--.
Line 49, "an opposite side of" should read --a side opposite to--.
Line 57, "little at" should read --low--.

COLUMN 4:
Line 67, "an" should be deleted.

COLUMN 5:
Line 26, "side" should read --sides--.
Line 27, "surface" should read --surfaces--.
Line 58, "deinking" should read --de-inking--.
Line 63, "one," should read --ones,--.

COLUMN 6:
Line 6, "strength" should read --strength.-- and "of" should be deleted.
Line 7, "paper." should be deleted.
Line 38, "cellar" should read --cellular--.

COLUMN 7:
Line 30, "or" should read --of--.
Line 48, "5 ml/$m^2$s-1/2" should read --5 m1/$m^2s^{-1/2}$--.

COLUMN 9:
Line 3, "one" should be deleted.
Line 43, "bar coater," should be deleted.

UNITED STATES PATENT AND TRADEMARK OFFICE

CERTIFICATE OF CORRECTION

PATENT NO. : 6,720,041 B2
APPLICATION NO. : 09/441877
DATED : April 13, 2004
INVENTOR(S) : Hitoshi Yoshino et al.

It is certified that error appears in the above-identified patent and that said Letters Patent is hereby corrected as shown below:

COLUMN 10:
Line 23, “boebmite” should read --boehmite--.
Line 25, “boebmite” should read --boehmite--.
Line 35, “boebmite” should read --boehmite--.
Line 63, “formed an” should read --forming an--.

COLUMN 11:
Line 39, “interplaner” should read --interplanar--.
Line 46, “planer” should read --planar--.
Line 60, “an” should be deleted.
Line 62, “interplaner” should read --interplanar--.
Line 67, “an” should be deleted.

COLUMN 13:
Line 43, “kaoline” should read --kaolin--.

COLUMN 15:
Line 36, “method” should read --methods--.
Line 43, “no” should read --any--.
Line 44, “specifications” should read --specification--.
Line 47, “an” should be deleted.

COLUMN 16:
Line 9, “paper” should read --Paper--.

COLUMN 22:
Lines 52-53 “(The Mixing Ratio Was Parts by Weight of the Silicate Per 100 Parts by Weight of the Alkoxide)” should read --(The mixing ratio was parts by weight of the silicate per 100 parts by weight of the alkoxide.)--.

COLUMN 25:
Line 13, “but observed” should read --but could be observed--.

COLUMN 31:
Line 35, “boebmite” should read --boehmite--.

UNITED STATES PATENT AND TRADEMARK OFFICE

CERTIFICATE OF CORRECTION

PATENT NO. : 6,720,041 B2
APPLICATION NO. : 09/441877
DATED : April 13, 2004
INVENTOR(S) : Hitoshi Yoshino et al.

It is certified that error appears in the above-identified patent and that said Letters Patent is hereby corrected as shown below:

COLUMN 32:
Line 4, “boebmite” should read --boehmite--.

Signed and Sealed this

Twenty-third Day of October, 2007

JON W. DUDAS
*Director of the United States Patent and Trademark Office*